US005664451A

United States Patent [19]

Schultz

[11] Patent Number: 5,664,451

[45] Date of Patent: Sep. 9, 1997

[54] ROLL FORMING MACHINE FOR AN INDETERMINATE LENGTH METAL ROOF PANEL

[75] Inventor: Robert E. Schultz, Hatfield, Pa.

[73] Assignee: Englert/Rollformer, Inc., Willow Grove, Pa.

[21] Appl. No.: 510,150

[22] Filed: Aug. 2, 1995

[51] Int. Cl.[6] ..... B21D 5/08

[52] U.S. Cl. ..... 72/181; 72/252.5; 72/379.6

[58] Field of Search ..... 72/177, 179, 181, 72/182, 379.6, 197, 198, 252.5, 196

[56] References Cited

U.S. PATENT DOCUMENTS

| | | | |
|---|---|---|---|
| 2,176,115 | 10/1939 | Yoder | 72/181 |
| 2,441,476 | 5/1948 | Ewald | 72/196 |
| 2,558,877 | 7/1951 | Ress | 72/196 |
| 2,639,660 | 5/1953 | Suderhauf et al. | 72/196 |
| 3,009,511 | 11/1961 | Le Bouef, Sr. | 72/181 |
| 3,636,903 | 1/1972 | Anderson et al. | 72/181 |
| 3,788,115 | 1/1974 | Beymer | 72/181 |
| 4,130,978 | 12/1978 | Chalmers et al. | 72/181 |
| 4,444,037 | 4/1984 | Norgate | 72/177 |
| 4,627,258 | 12/1986 | Loges et al. | 72/197 |
| 4,660,399 | 4/1987 | Suter et al. | 72/181 |
| 4,913,910 | 4/1990 | McCarville et al. | 72/197 |
| 5,007,271 | 4/1991 | Boegli | 72/196 |
| 5,038,592 | 8/1991 | Knudson | 72/181 |

FOREIGN PATENT DOCUMENTS

| | | |
|---|---|---|
| 0163310 | 12/1985 | European Pat. Off. . |
| 59-169626 | 9/1984 | Japan . |
| 5-161921 | 6/1993 | Japan . |

*Primary Examiner*—David Jones
*Assistant Examiner*—John Paradiso
*Attorney, Agent, or Firm*—David L. Davis

[57] ABSTRACT

A machine for forming a metal roof panel of indeterminate length from a uniform width supply strip of sheet metal having a pair of parallel straight longitudinal edges. The machine has a series of spaced forming stations each having upper and lower shaping rollers between which the sheet metal strip is passed so as to impart a desired shape to the sheet metal strip which is uniform the length of sheet metal strip after it exits the apparatus. A stamping station located in the path of the sheet metal strip before the series of spaced forming stations is effective to form linear impressions in the sheet metal strip. The linear impressions are transverse to the longitudinal edges of the sheet metal strip, with each such impression having its lateral extent limited such that the succeeding series of shaping rollers do not impinge thereon.

7 Claims, 13 Drawing Sheets

ROLL FORMING MACHINE FOR AN INDETERMINATE LENGTH METAL ROOF PANEL

CROSS-REFERENCE TO RELATED APPLICATIONS

This application is related to U.S patent application Ser. No. 29/042,170, now U.S. Design Pat. No. D-372,545 and to U.S. design patent application Ser. No. 08/510,149 both filed on even date herewith, and assigned to the assignee of the present invention.

BACKGROUND OF THE INVENTION

This invention relates to roofing materials and, more particularly, to an improved roll forming machine for producing an indeterminate length metal roof panel.

Traditional roofing material is supplied in relatively small pieces. For example, slate tiles and wood shakes are supplied as individual shingle units. Conventional asbestos shingles are supplied as panels approximately three feet long with one row of singles. Installation of such roofing material is therefore very time consuming, since only a small area of the roof can be covered by each shingle or panel of roofing material. Another problem with traditional roofing material is the disposal thereof. In addition to taking up space, some traditional roofing materials, such as asbestos shingles, are considered to be hazardous substances.

Metal roofing is known which is both relatively economical to install and which may be recycled. However, such metal roofing is typically provided as elongated panels which are installed generally vertically from the eave to the peak of a roof. Such roofing material has been used almost exclusively for commercial and industrial buildings because its aesthetic appearance is substantially different from generally accepted notions of how a residential roof should appear. The cross-referenced patent applications disclose an improved metal roof panel which is shaped and formed to simulate the appearance of traditional residential roofing material.

Installation time of roofing material is inversely related to the area covered by each roof panel. Therefore, if a metal roof panel was available that traversed a complete section of roof,this would save installation time. However, different roofs have different lengths, so standardizing panel sizes would be difficult. On the other hand, it is known to use a roll forming machine on-site to shape sheet metal supplied in the form of a coiled strip into roof gutters and house siding of indeterminate length. It is therefore an object of this invention to provide a roll forming machine for producing on-site an indeterminate length metal roof panel which simulates the appearance of traditional roofing material.

SUMMARY OF THE INVENTION

The foregoing and additional objects are attained in accordance with the principles of this invention by providing apparatus for forming a metal roof panel of indeterminate length from a uniform width supply strip of sheet metal having a pair of parallel straight longitudinal edges. The apparatus comprises a series of spaced forming stations each having upper and lower shaping rollers between which the sheet metal strip is passed so as to impart a desired shape to the sheet metal strip which is uniform along the length of the sheet metal strip after it exits the apparatus. A stamping station located in the path of the sheet metal strip before the series of spaced forming stations is effective to form linear impressions in the sheet metal strip. Each such impression has its lateral extent limited such that the succeeding series of shaping rollers does not impinge thereon.

In accordance with an aspect of this invention, the stamping station is effective to form each linear impression as a straight line transverse to the longitudinal edges of the sheet metal strip.

In accordance with a further aspect of this invention, the stamping station is effective to form each straight line impression orthogonally to said longitudinal edges.

In accordance with another aspect of this invention, the stamping station is a rotary stamper comprising a first roller formed with a straight axial slot on its surface, the axis of the first roller being orthogonal to the longitudinal edges, a second roller having a straight axial die protruding from its surface, the die being complementary to the slot and adapted to force the sheet metal into the slot when the sheet metal strip is fed between the first and second rollers to thereby form a straight line impression in the sheet metal strip, and means for rotating the first and second rollers in registration so that the die enters the slot when the first and second rollers are rotated.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
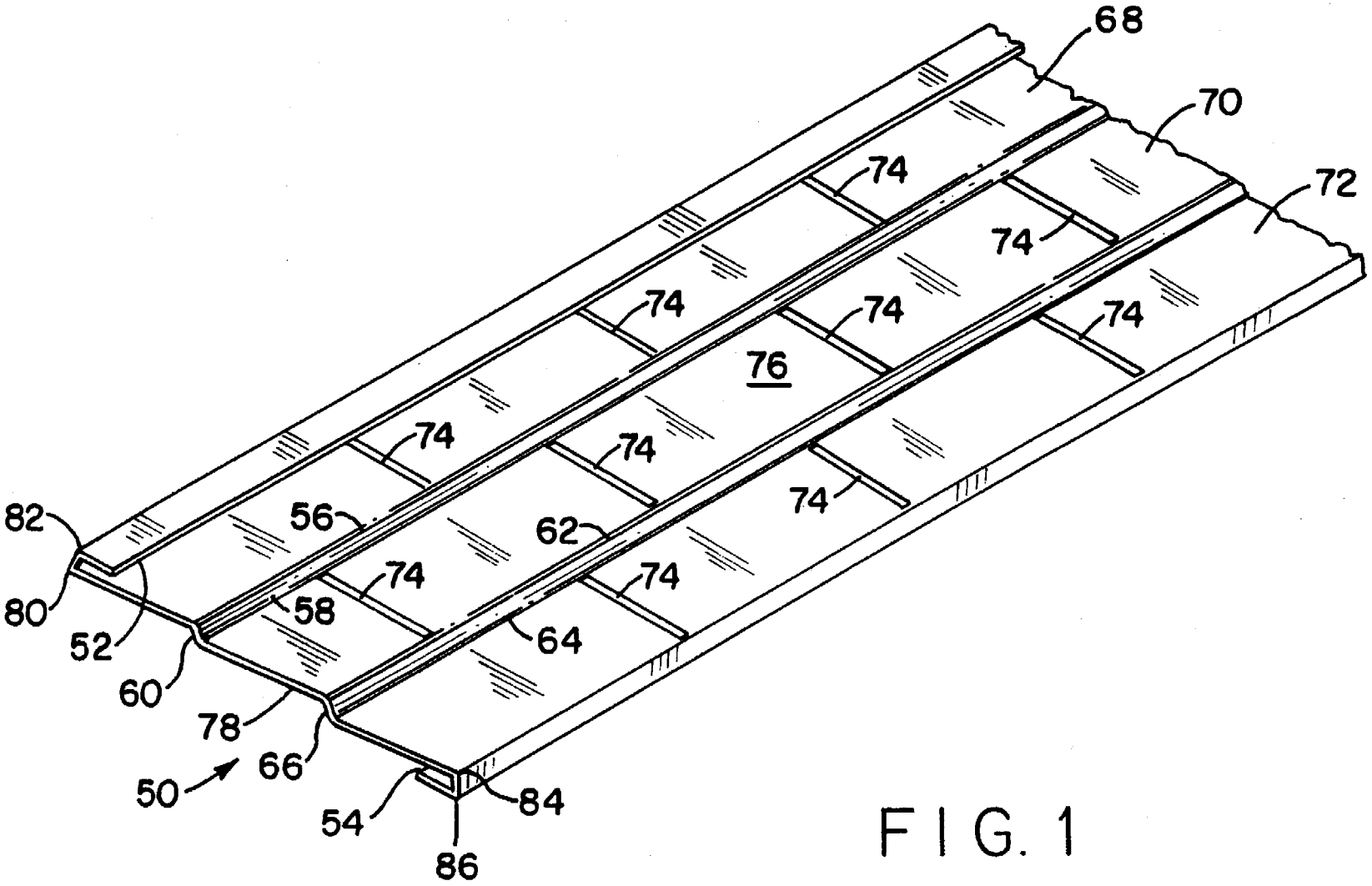
FIG. 1 is a perspective view of an illustrative metal roof panel of indeterminate length produced by apparatus constructed in accordance with the principles of this invention.

FIG. 1 shows a metal roof panel, designated generally by the reference numeral 50, which can be of any desired length (indeterminate length) so that it can seamlessly traverse a complete section of roof. Accordingly, the design of the roof panel 50 is such that it can be shaped from a coiled strip of sheet metal by an on-site roll forming machine constructed according to this invention and fully described hereinafter.

The panel 50 has an upper longitudinal edge 52 and a lower longitudinal edge 54. The edges 52, 54 are parallel to each other, since the sheet metal strip from which the panel 50 is formed is of uniform width. The panel 50 is shaped by being bent in opposite directions at substantially right angles along at least one pair of straight lines 56, 58 parallel to the edges 52, 54 so as to form at least one Z-shaped bend 60 parallel to the edges 52, 54. Illustratively, there is a second set of straight lines 62, 64 and a second Z-shaped bend 66. The spacing between adjacent bends 60, 66 and between each of the edges 52, 54 and the bend adjacent each edge is substantially equal so that the panel 50 is divided into at least two (illustratively three) longitudinal rows 68, 70, 72.

The panel 50 is further formed with a plurality of linear impressions 74. Each of the impressions 74 extends only within a respective one of the rows 68, 70, 72. Illustratively, the linear impressions 74 are straight lines transverse to the edges 52, 54. Preferably, the straight line impressions 74 are each orthogonal to the edges 52, 54. Additionally, the impressions 74 within each of the rows 68, 70, 72 are equally spaced, and the impressions 74 in adjacent rows extend substantially mid-way between each other. The panel 50 has a first, upper, surface 76 which is visible when the panel 50 is installed on a roof and a second opposed, lower, surface 78 which is hidden when the panel 50 is installed on a roof. As shown, the z-shaped bends 60, 66 are so oriented that they form downward steps when the upper surface 76 is traversed in a direction from the upper edge 52 to the lower edge 54. Accordingly, due to the "stepping" effect of the rows 68, 60, 72 and the staggering of the impressions 74, the panel 50 simulates three rows of overlapping offset roofing shingles.

In addition to the aforedescribed forming of the panel 50 to simulate rows of shingles, the edges 52, 54 are bent into complementary shapes so that the upper edge of a first panel can be interlocked with the lower edge of a duplicate second panel. Illustratively, the upper longitudinal edge 52 is formed with two parallel right angle bends 80, 82 so that it overlies the upper surface 76. Similarly, the lower longitudinal edge 54 is formed with two parallel right angle bends 84, 86 so that it underlies the lower surface 78.

Figure 2:
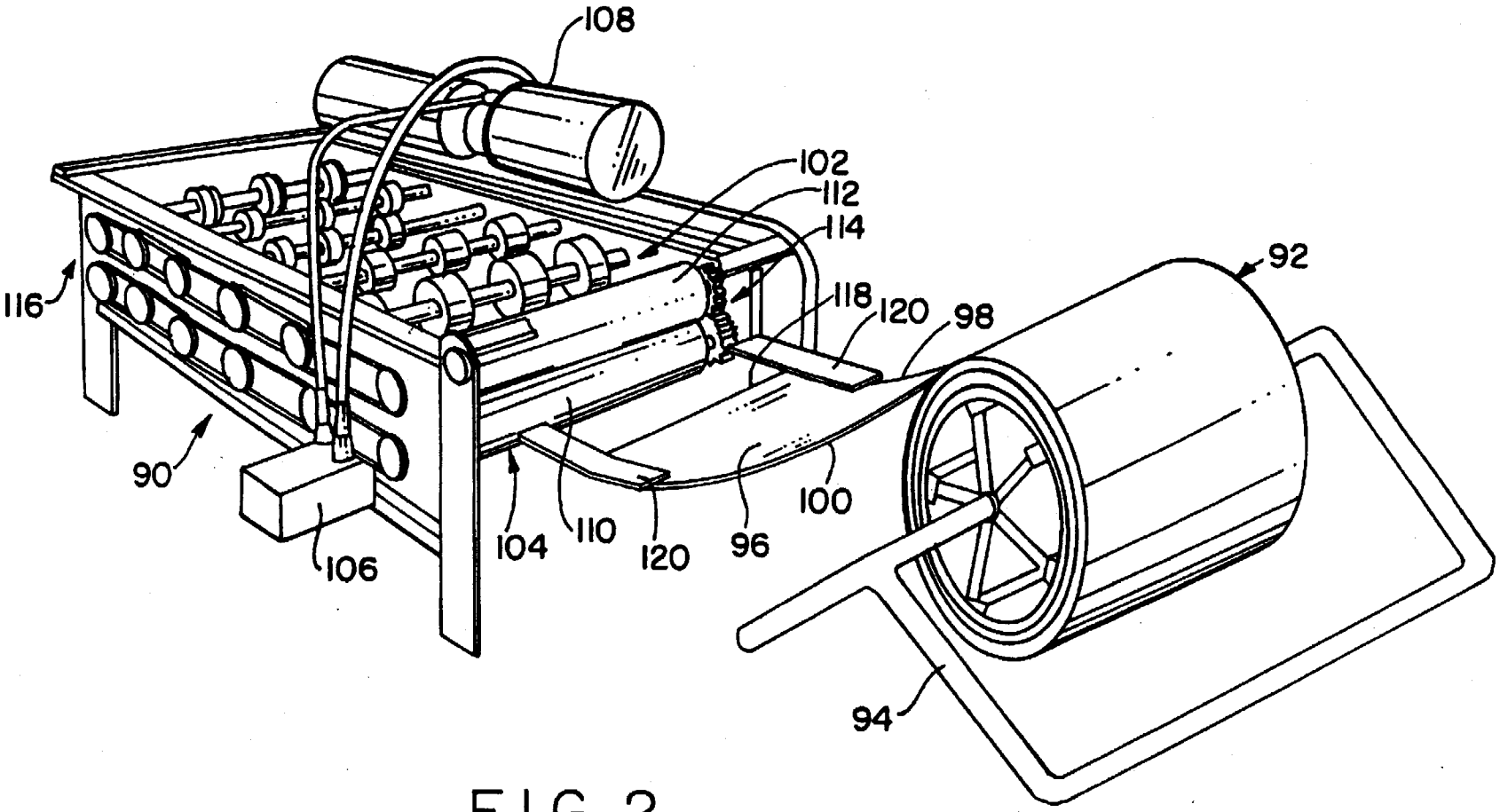
FIG. 2 is a perspective view of an inventive roll forming machine with covers removed, for producing the roof panel of FIG. 1.

The machine illustrated in FIG. 2 and designated generally by the reference numeral 90 is of the type known in the art as a roll forming machine and is specifically designed to form the panel 50 from the supply coil 92 of sheet metal. The machine 90, along with the coil 92 on its stand 94, are adapted to be mounted on the bed of a pick-up truck, van, trailer, or the like, as is conventional, so that it can be transported to, and used at, a site where roof panels are to be installed.

The coil 92 provides a uniform width supply strip of sheet metal 96 having a pair of parallel straight longitudinal edges 98, 100. The edges 98, 100 subsequently become the edges 52, 54, respectively, of the panel 50 after passing through the machine 90. The machine 90 includes a series of spaced forming stations 102, each of which has upper and lower driven shaping rollers between which the strip 96 is passed so as to impart a desired shape to the strip 96 which is uniform along the length of the strip 96 after it exits the machine 90, as is generally known in the roll forming art. The machine 90 further includes a stamping station 104 located in the path of the strip 96 before the series of spaced forming stations 102. Illustratively, motive power for the machine 90 is provided by a hydraulic motor 106 driven by a motor/compressor assembly 108 operated from a source of electric power (not shown), which may be a portable electric generator. The stamping station 104 includes a first roller 110 and a second roller 112. The motor 106 is coupled to directly drive the roller 110, which is coupled to the roller 112 through gearing 114 so that the second roller 112 is driven in registration with the first roller 110. A drive train 116 is provided to drive the rollers of the forming stations 102 from the first and second rollers 110, 112.

Figure 3:
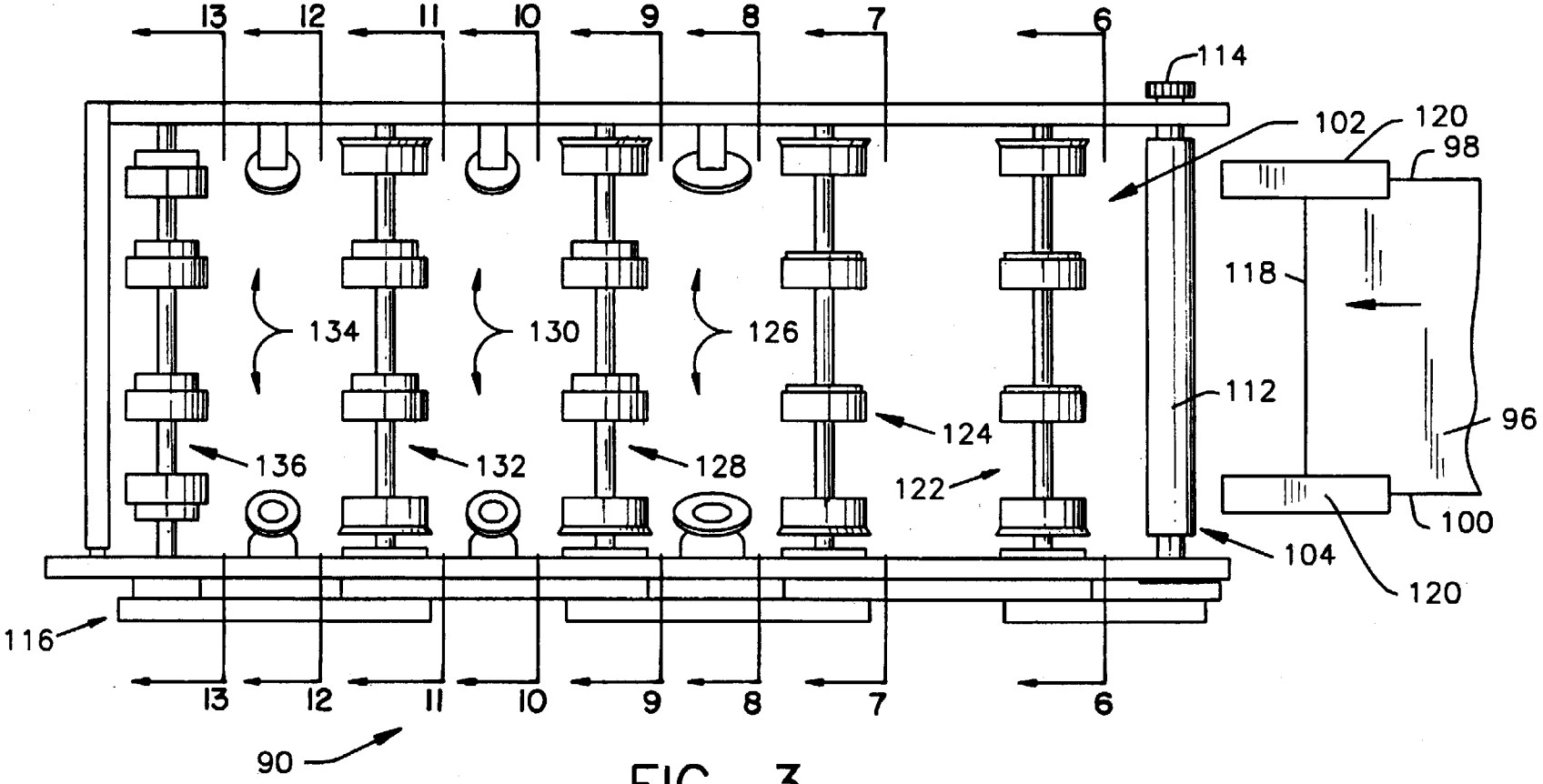
FIG. 3 is a schematic top plan view of the machine of FIG. 2.

As shown in FIG. 3, the leading edge 118 of the strip 96 is passed through the guides 120 before reaching the stamping station 104. After the stamping station 104, the strip 96 passes through a first forming station 122, a second forming station 124, a first edge guiding station 126, a third forming station 128, a second edge guiding station 130, a fourth forming station 132, a third edge guiding station 134, and a fifth forming station 136. The forming stations 122, 124, 128, 132, 136 are driven from the drive train 116, whereas the edge guiding stations 126, 130, 134 are free wheeling. Although not shown in the drawings, after the finished panel 50 exits the machine 90, it passes through a cutter which is operable to cut the finished panel 50 to any desired length. Preferably, a profile sheer would be utilized to prevent deformation of the panel 50 when it is cut.

Figure 4:
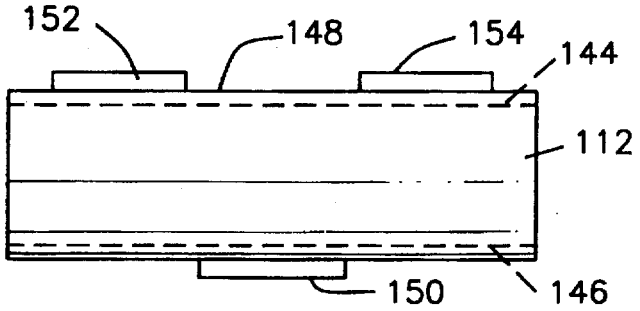
FIG. 4 is a plan view of the second roller of the stamping station of the machine of FIG. 2.
Figure 5:
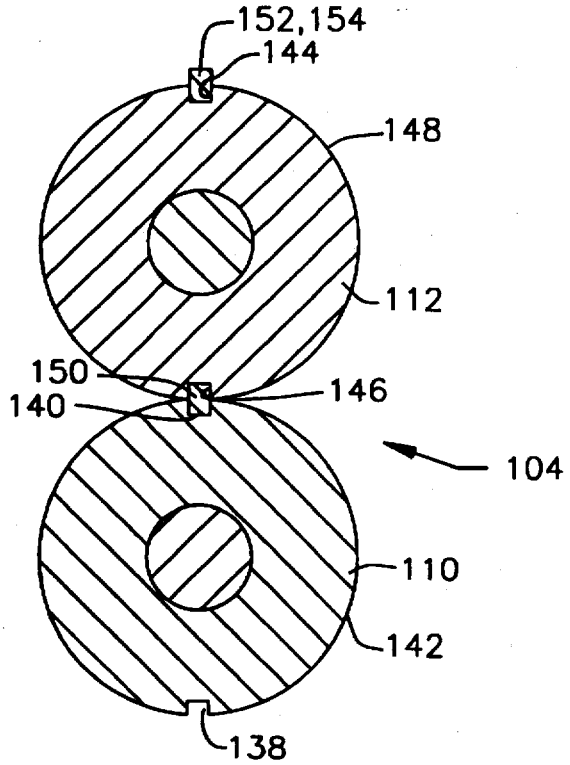
FIG. 5 is a cross-sectional view of the stamping station of the machine of FIG. 2
Figure 5A:
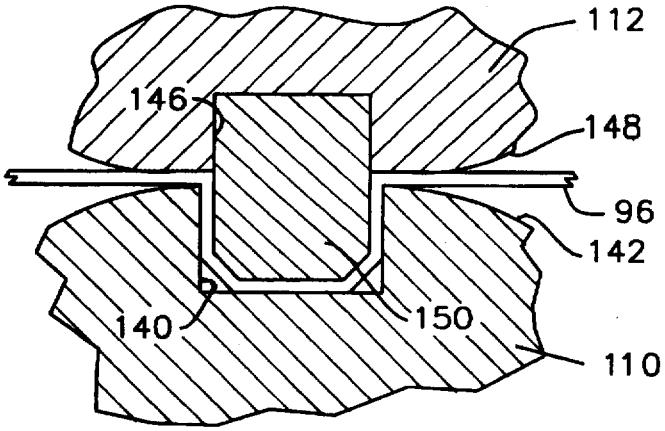
FIG. 5A is an enlarged cross-sectional view of a portion of the stamping station of FIG. 5 showing how a linear impression in the sheet metal is formed thereby.

FIGS. 4, 5 and 5A show details of the stamping station 104. The first roller 110 is formed with two diametrically opposed straight axial slots 138, 140 on its surface 142. Similarly, the second roller 112 is formed with two diametrically opposed axial slots 144, 146 on its surface 148. The slot 146 has mounted therein a straight axial die 150, and in the slot 146 are mounted the axial dies 152 and 154. The die 150 is complementary to the slot 140 of the roller 110 and the dies 152, 154 are complementary to the slot 138 of the roller 110. The rollers 110 and 112 have the same diameter and are rotated at the same speed, in registration, so that the die 150 enters the slot 140 and the dies 152, 154 enter the slot 138 as the rollers 110, 112 are rotated. Preferably, the protruding edges of the dies 150, 152, 154 are chamfered, as best shown in FIG. 5A, to aid their entry into the respective slots 138, 140. As best shown in FIG. 5A, when the strip 96 passes between the rollers 110, 112, the dies 150, 152, 154 make the straight line impressions 74 therein. As best shown in FIG. 4, the length of the dies 150, 152, 154 and their relative positions axially along the roller 112 is such that the impressions made by each of the dies 150, 152, 154 is limited to be within a respective longitudinal row 70, 72, 68, respectively, of the finished panel 50 so that there are two longitudinal strips parallel to the longitudinal edges 98, 100 in which there are no straight line impressions 74. These two longitudinal strips are between the longitudinal rows 68 and 70 and between the longitudinal rows 70 and 72, respectively. Accordingly, the rollers of the succeeding forming stations 102 do not impinge on the straight line impressions 74 when making the bends 60, 66. The spacing between adjacent impressions 74 within a row is equal to the diameter of the rollers 110,112.

Figure 6:
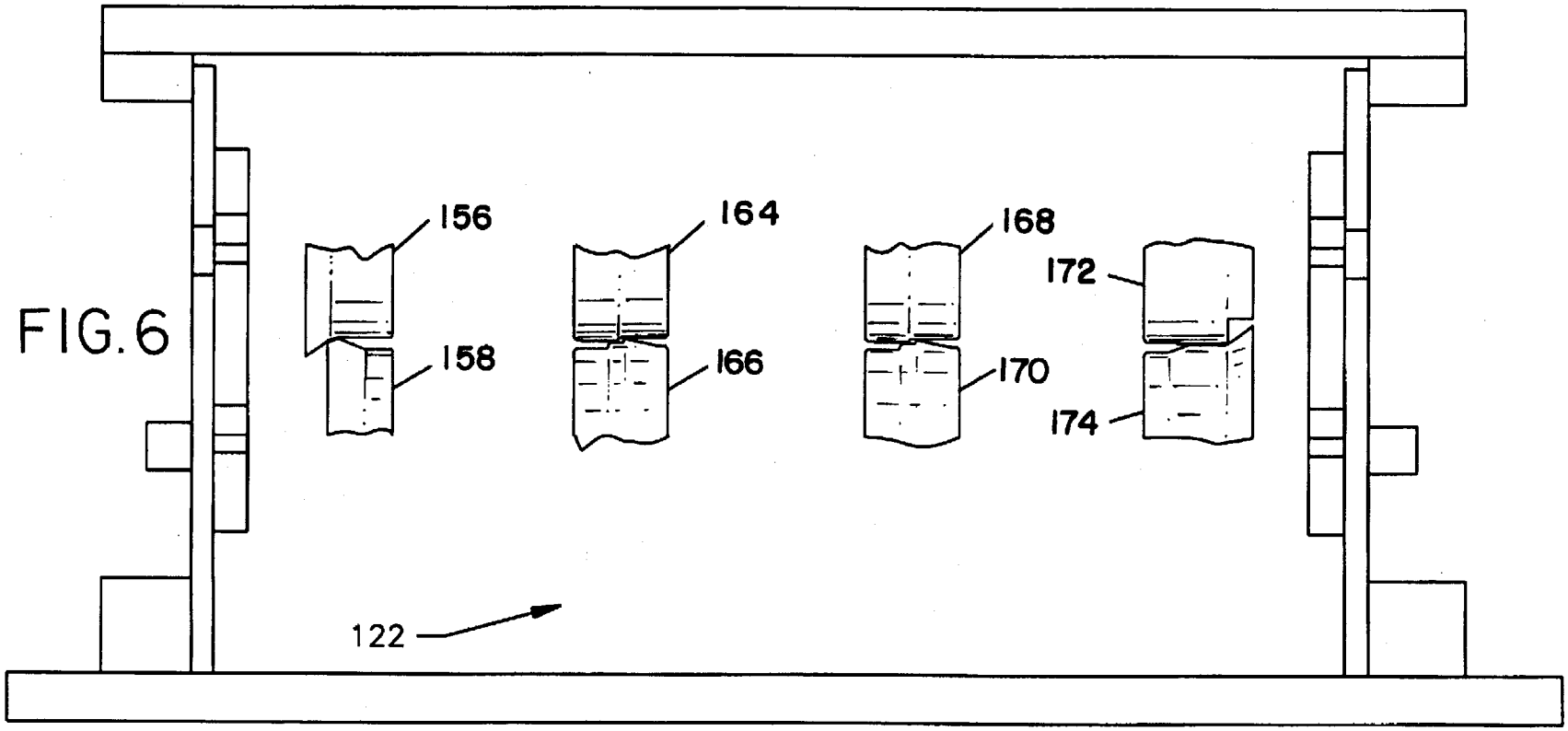
FIG. 6 is a partial schematic view of a forming station taken along the line 6—6 of FIG. 3, with FIG. 6A illustrating the profile of the sheet metal formed at that station.
Figure 6A:
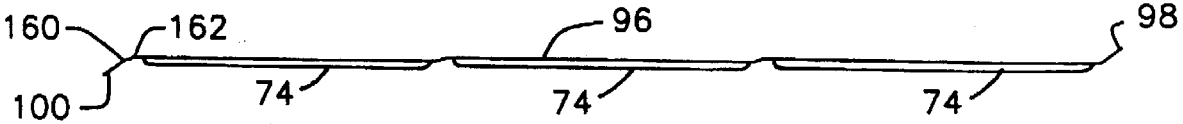

FIG. 6 illustrates the first forming station 122, showing in profile only the engaging regions of the forming rolls which make the longitudinal bends in the strip 96. As is known, bending of the strip 96 should be done gradually. Thus, if a 90° bend is called for, this should be done in several stages. Accordingly, the first forming station 122 begins the bending process by making shallow bends. The forming station 122 has four pairs of forming rollers driven by the drive train 116. The leftmost roller pair 156, 158 is designed to put two closely spaced bends 160, 162 (FIG. 6A) near the edge 100 to begin the formation of the interlocking bend along the lower edge of the panel 50. The roller pair 164, 166 start the formation of the Z-shaped 5end 66 and the roller pair 168, 170 start the formation of the Z-shaped bend 60. The roller pair 172, 174 form a bend near the edge 98 of the strip 96 to begin the formation of the interlocking bend along the upper edge of the panel 50. It is to be noted that all of the lower rollers 158, 166, 170, 174 are cut away immediately adjacent where they form the bends in the strip 96 so as not to impinge upon the impressions 74 made by the stamping station 104. It is the lower set of rollers 158, 166, 170, 174 which are cut away because the impressions 74 extend below the strip 96.

Figure 7:
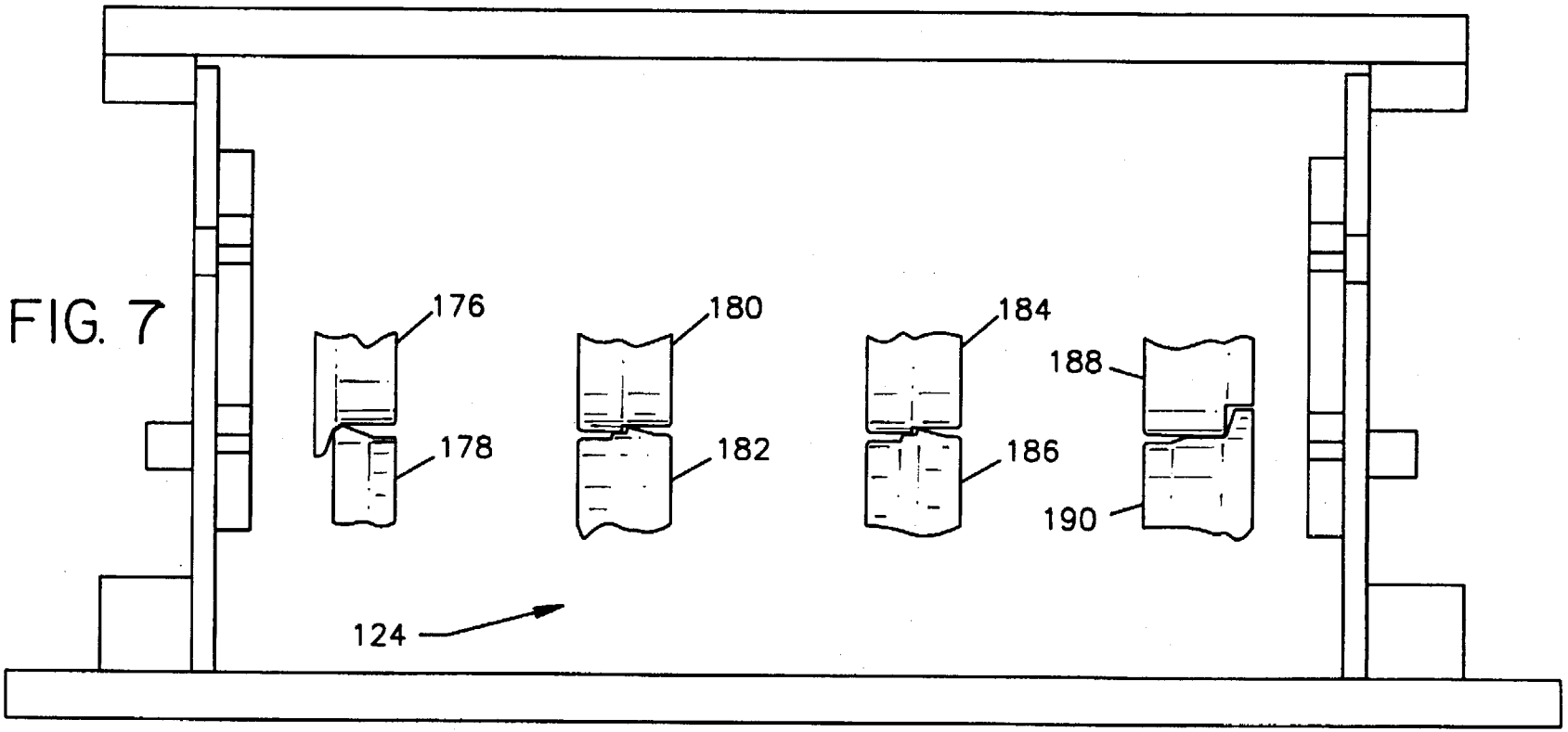
FIG. 7 is a partial schematic view of a forming station taken aloe the line 7—7 of FIG. 3, with FIG. 7A illustrating the profile of the sheet metal formed at that station.
Figure 7A:
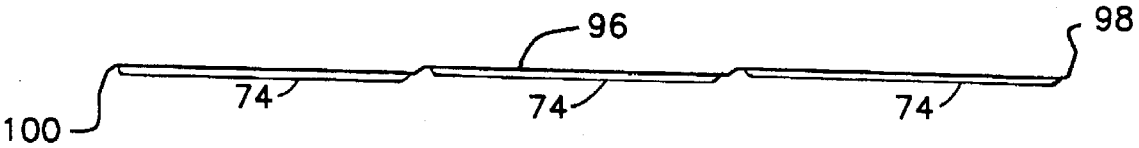

As shown in FIGS. 7 and 7A, the forming station 124 steepens the angles of the bends previously made by the forming station 122. Thus, the roller pair 176, 178 is aligned with and follows the roller pair 156, 158 to steepen the bends 160, 162. Similarly, the roller pair 180, 182 follows the roller pair 164, 166; the roller pair 184, 186 follows the roller pair 168, 170; and the roller pair 188, 190 follows the roller pair 172, 174. Again, the lower rollers 178, 182, 186, 190 are cut away so as not to impact the impressions 74.

Figure 8:
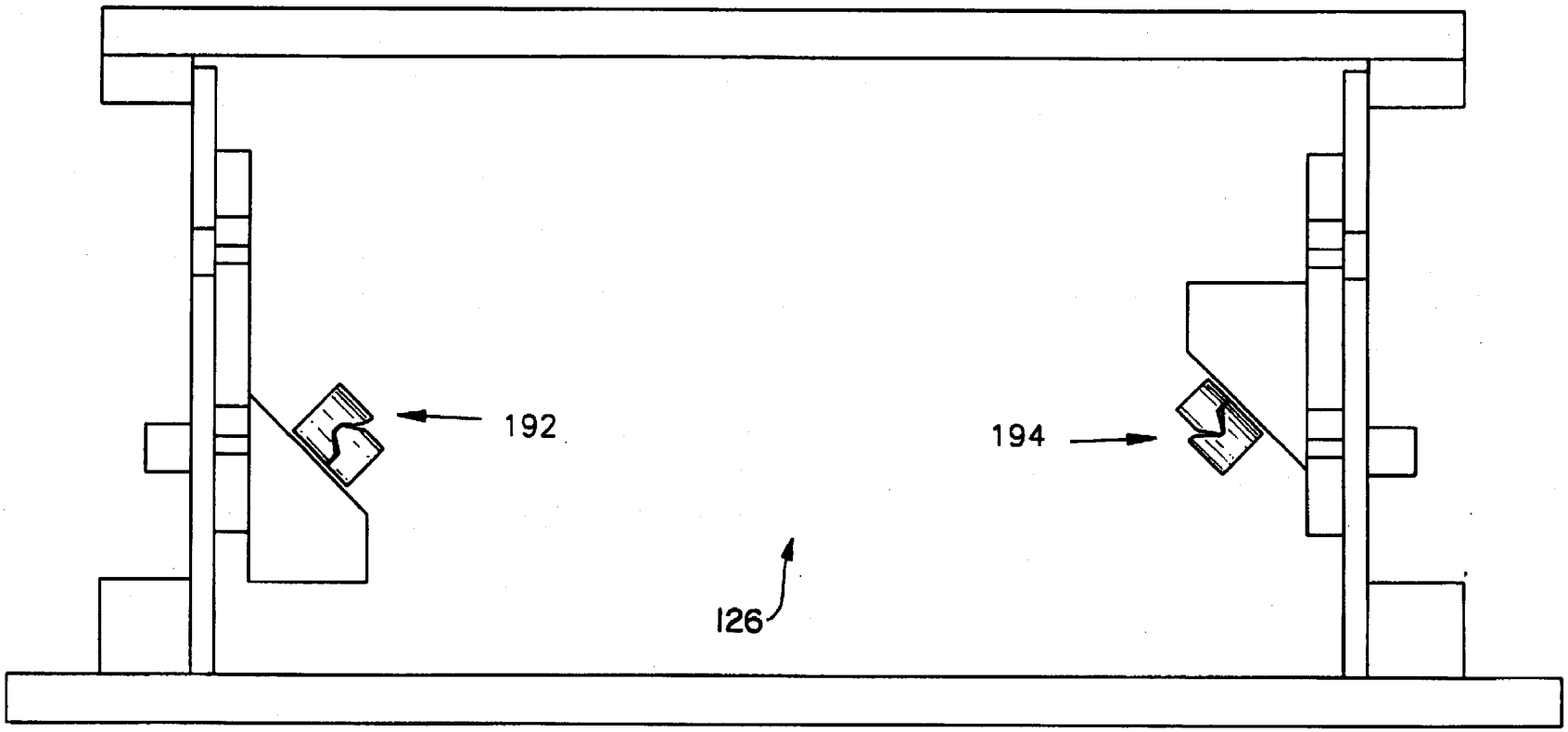
FIG. 8 is a partial schematic view of a forming station taken a long the line 8—8 of FIG. 3.

The edge guiding station 126 shown in FIG. 8 includes the roller set 192 and the roller set 194, both of which are free wheeling, which guide the edges 100, 98, respectively, and further enhance the bends made therein by the preceding forming stations.

Figure 9:
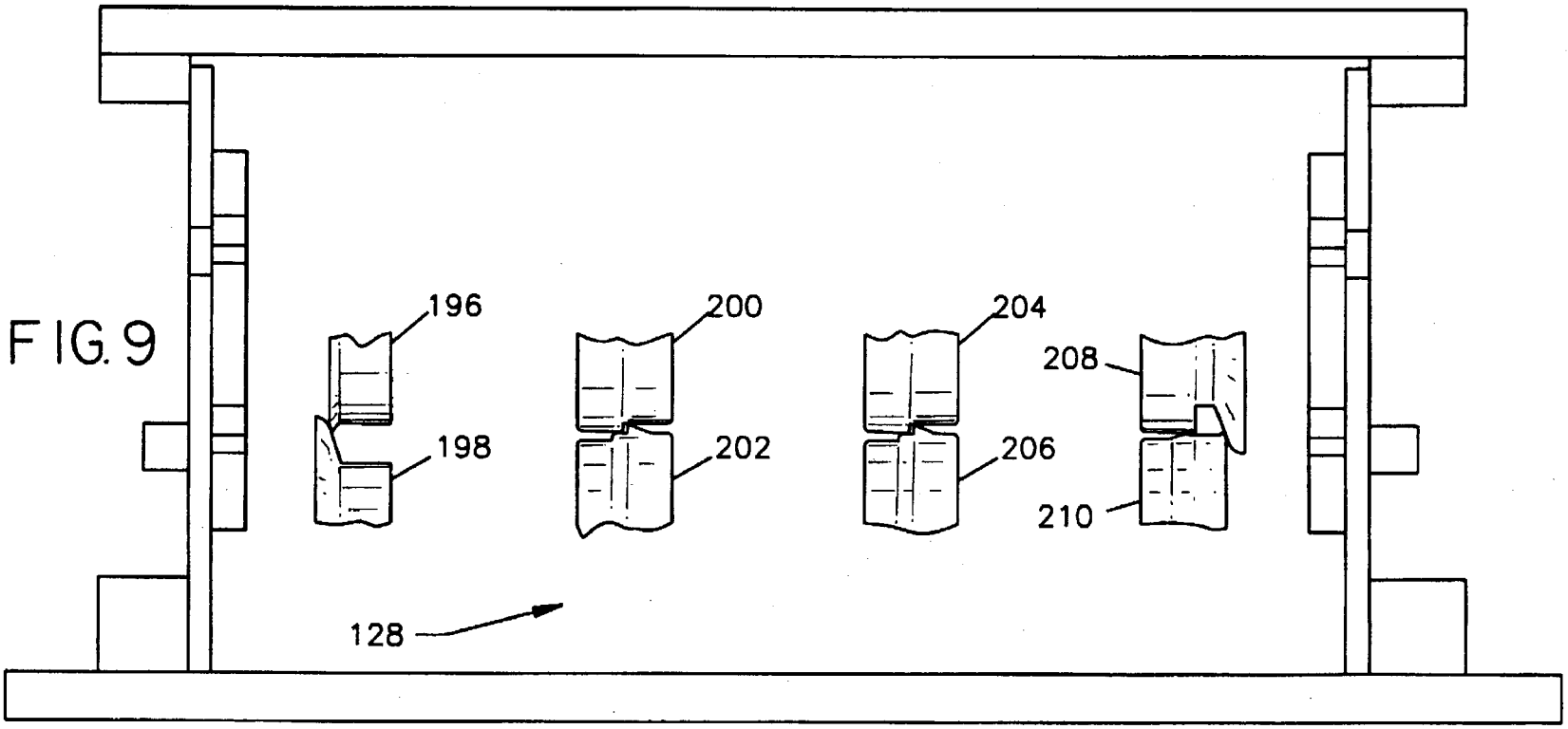
FIG. 9 is a partial schematic view of a forming station taken along the line 9—9 of FIG. 3, with FIG. 9A illustrating the profile of the sheet metal formed at that station.
Figure 9A:
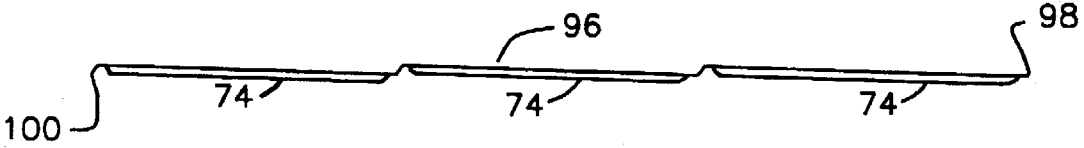

Referring now to FIGS. 9 and 9A, the forming station 128 includes the roller pairs 196, 198; 200, 202; 204, 206; and 208, 210, which steepen the bends made by the preceding forming stations 122, 124. Again, the lower rollers 198, 202, 206, 210 are cut away so as not to impact upon the impressions 74.

Figure 10:
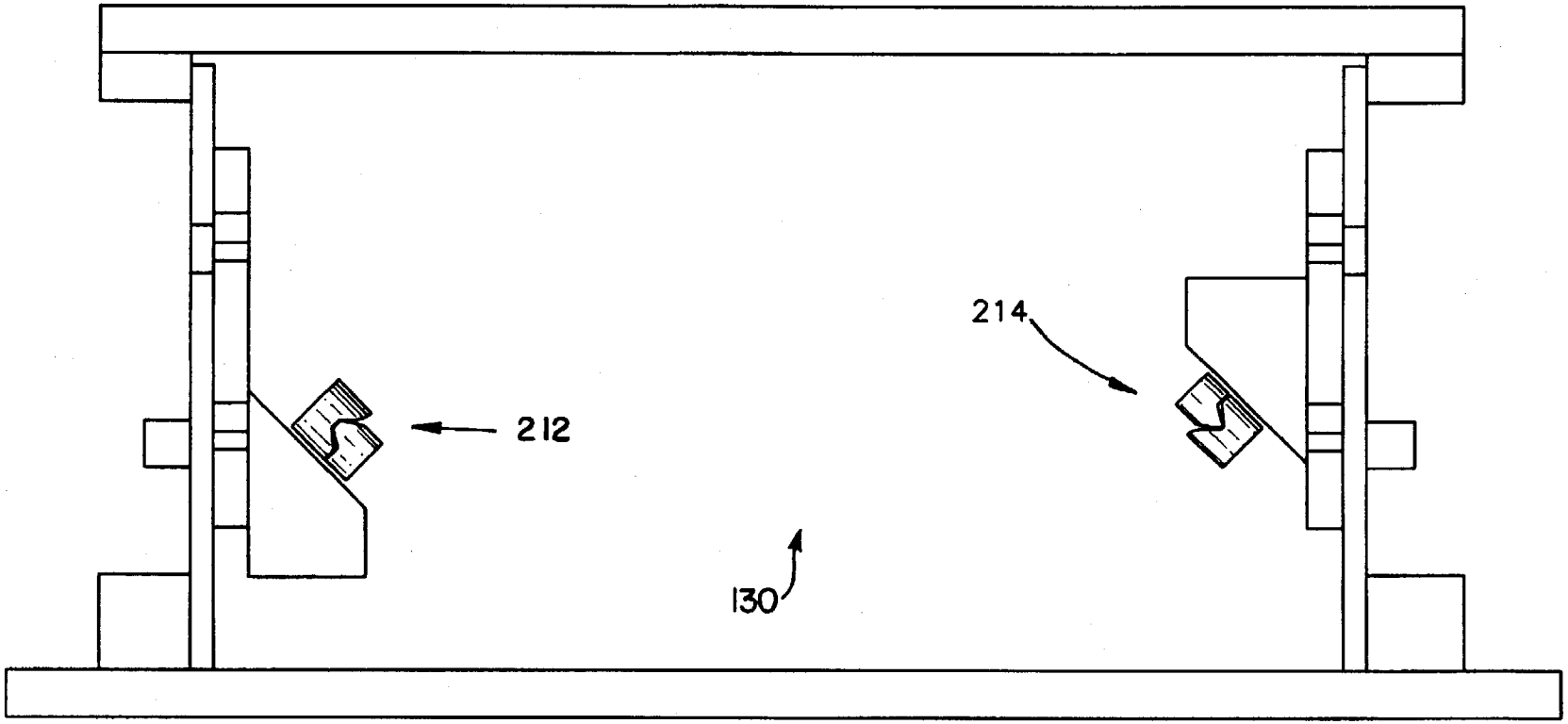
FIG. 10 is a partial schematic view of a forming station taken along the line 10—10 of FIG. 3.

As shown in FIG. 10, the edge guiding station 130 includes the roller set 212 and the roller set 214, both of which are free wheeling, and which function to guide and enhance the bending of the edges, of the strip 96 made by the preceding forming stations.

Figure 11:
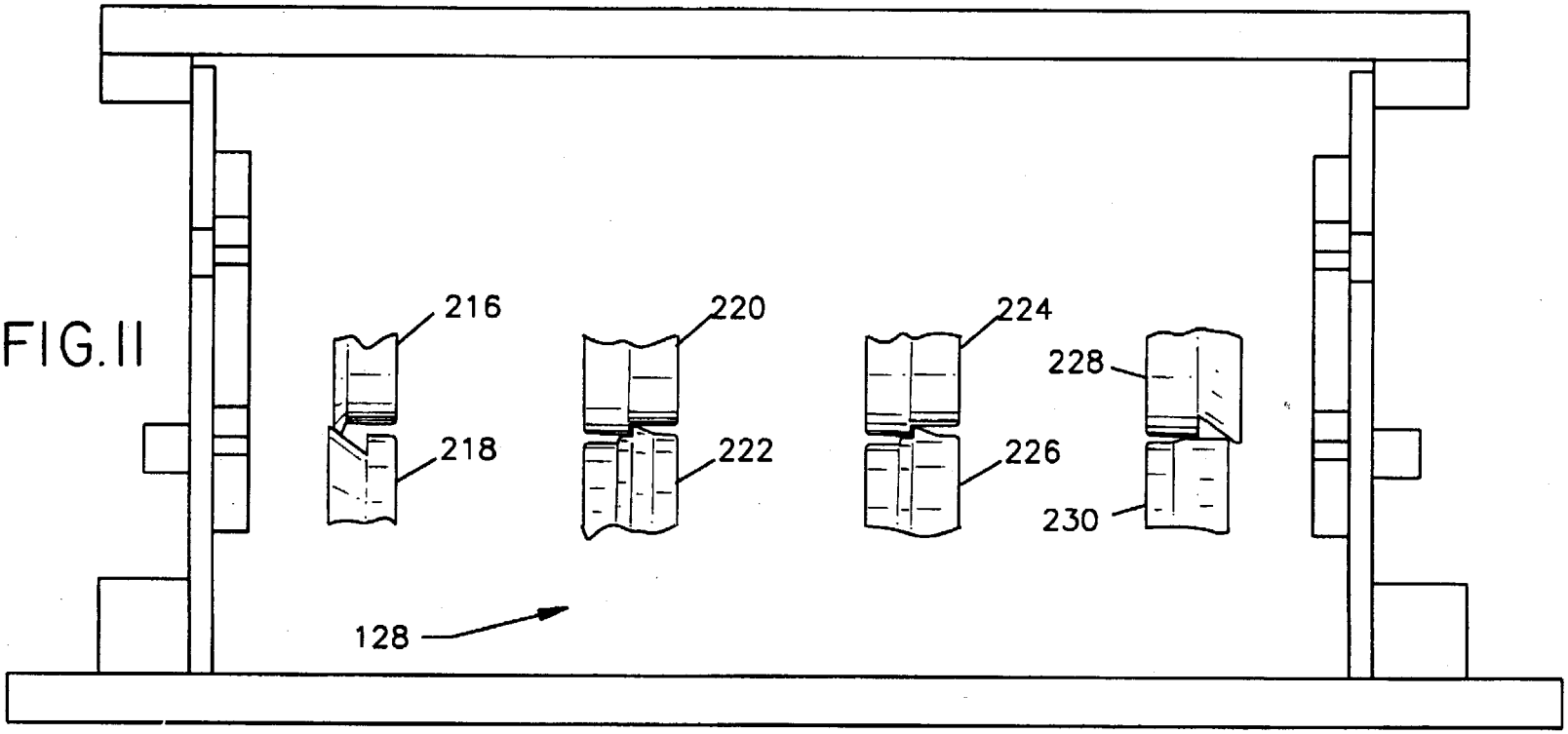
FIG. 11 is a partial schematic view of a forming station taken along the line 11—11 of FIG. 3, with FIG. 11A illustrating profile of the sheet metal formed at that station.
Figure 11A:
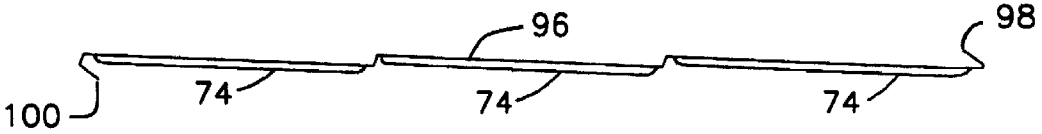

As shown in FIGS. 11 and 11A, the forming station 132 includes the roller pair 216, 218; the roller pair 220, 222; the roller pair 224, 226; and the roller pair 228, 230. These roller pairs function to steepen the bends made by the preceding forming stations. Again, the lower rollers 218, 222, 226, 230 are cut away so as not to impact on the impressions 74.

Figure 12:
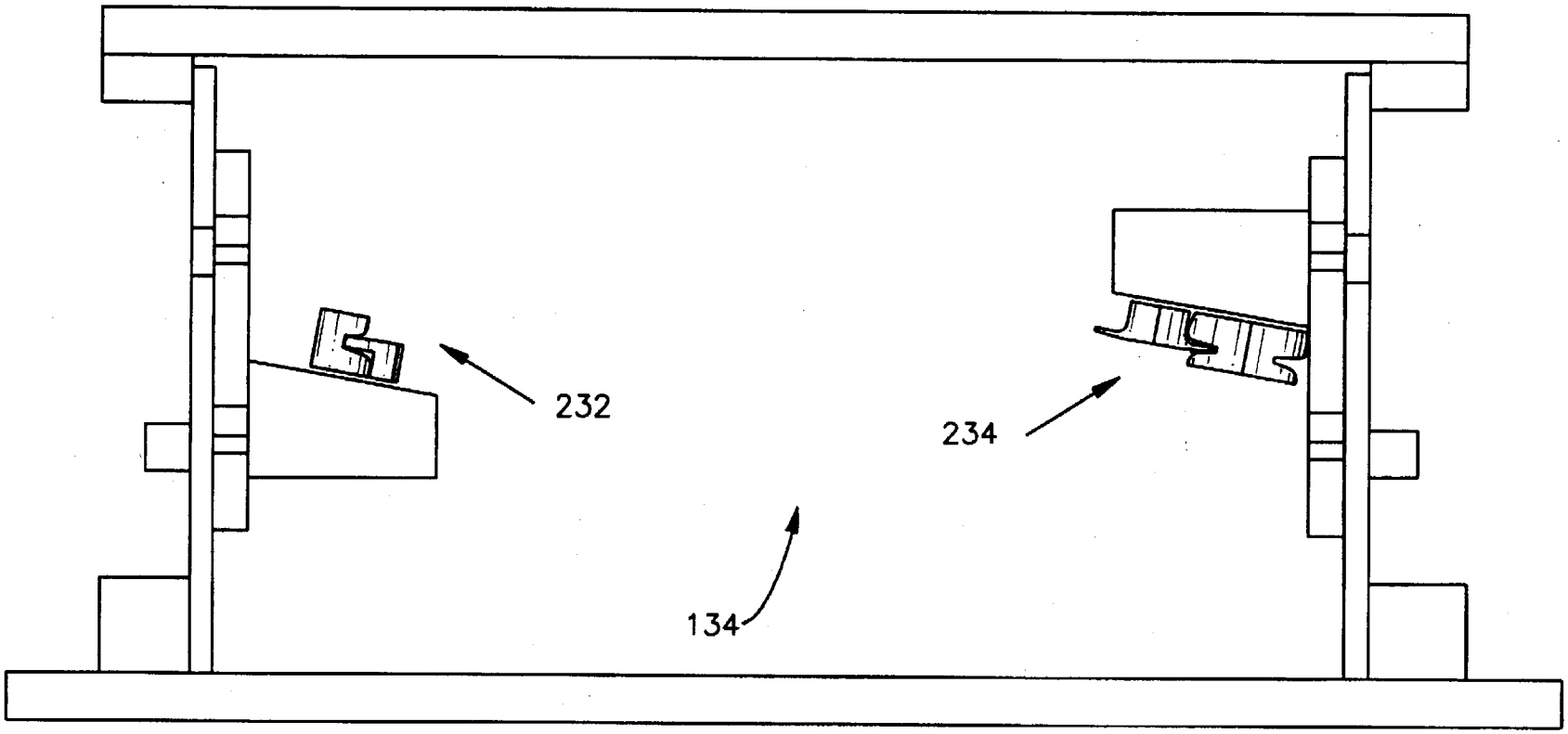
FIG. 12 is a partial schematic view of a forming station taken along the line 12—12 of FIG. 3.

The edge guiding station 134 shown in FIG. 12 includes the roller set 232 and the roller set 234, both of which are free wheeling, and which function to guide and enhance the bending of the edges of the strip 96.

Figure 13:
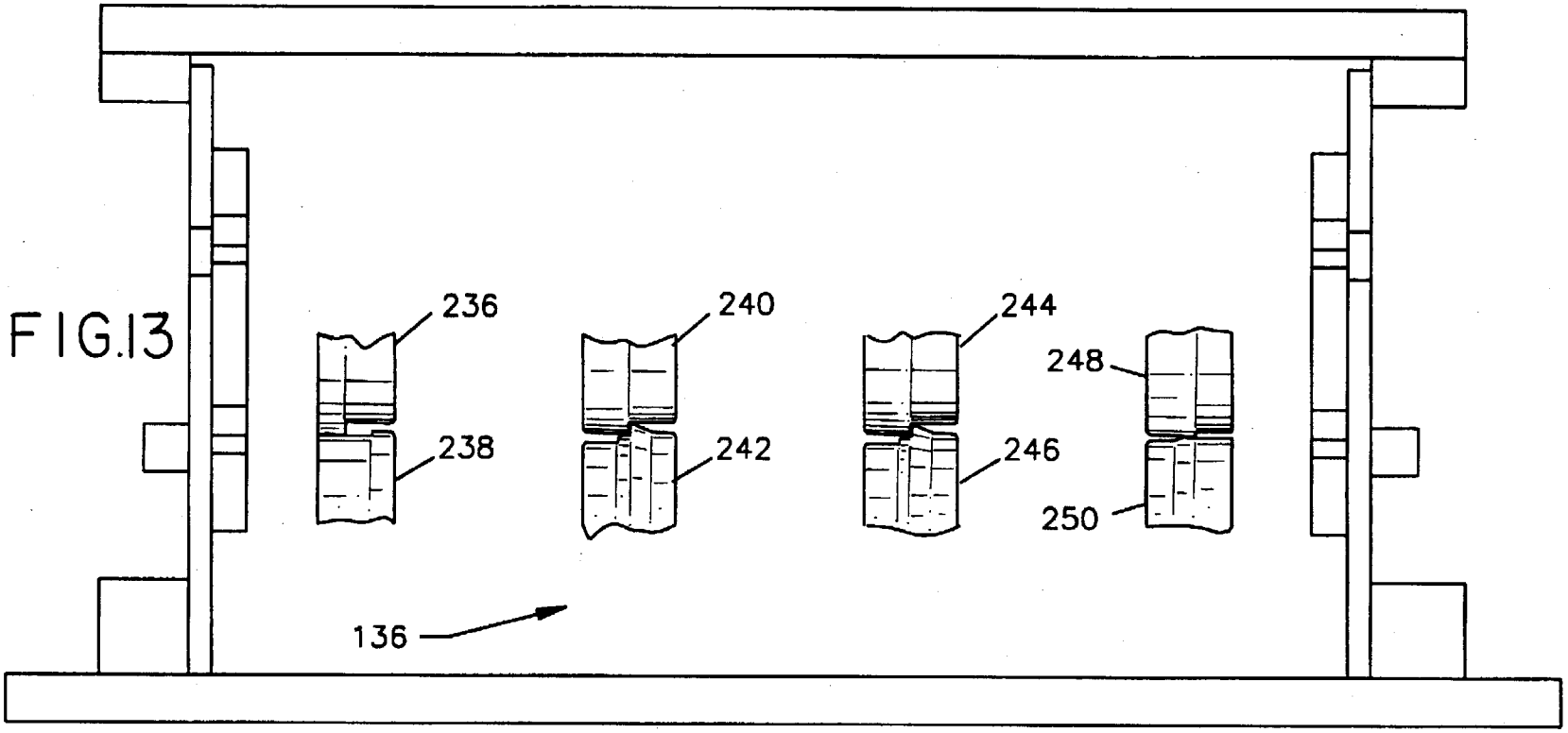
FIG. 13 is a partial schematic view of a forming station taken alone the line 13—13 of FIG. 3, with FIG. 13A illustrating the profile of the sheet metal formed at that station.
Figure 13A:
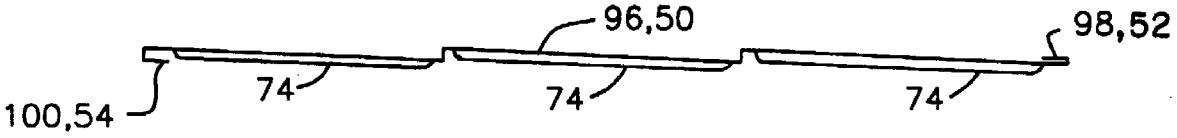

As shown in FIGS. 13 and 13A, the final forming station 136 includes the roller pair 236, 238; the roller pair 240, 242; the roller pair 244, 246; and the roller pair 248, 250. These roller pairs steepen the previously made bends into 90° bends, as is clear from FIG. 13A, to provide the final form for the panel 50. Again, the lower rollers 238, 242, 246, 250 are cut away so as not to impact on the impressions 74.

Figure 14:
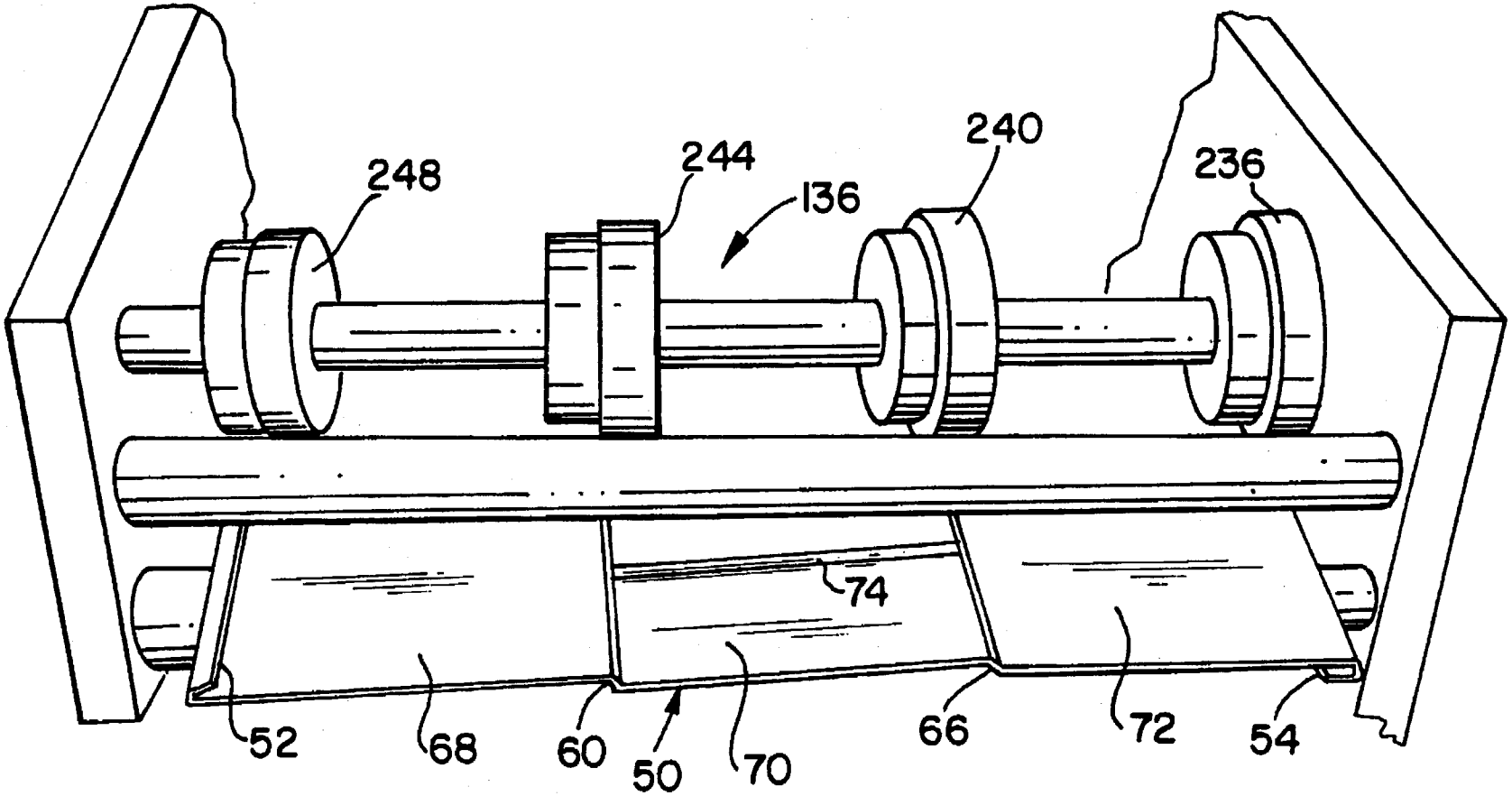
FIG. 14 is a view of the rear of the roll forming machine of FIG. 2, showing a finished metal roof panel exiting the machine.

FIG. 14 illustrates the finished roof panel 50 exiting the roll forming machine 90. The panel 50 is of indeterminate length, only limited by the capacity of the supply coil 92. As previously discussed, the panel 50 would pass through a cutting station (not shown) where it would be cut to whatever length is desired.

As illustrated, the panel 50 is formed with two Z-shaped bends 60, 66 so that it is divided into three longitudinal rows 68, 70, 72. It is understood that more or fewer Z-shaped bends could be provided by changing the number of roller pairs in each of the forming stations. Further, the roof panel 50 has been shown as having straight line impressions 74. Thus, the panel 50 simulates a plurality of rows of overlapping offset roofing shingles which are rectangular and of equal size. Thus, the impressions 74 are straight lines orthogonal to the edges 52, 54. Different regions of the United States, and different countries as well, may have different traditional roofing materials, which are not necessarily of rectangular shape and equal size. In such case, the impressions within each row would still be linear, but would not necessarily be straight lines orthogonal to the edges 52, 54. Thus, impressions can be formed in the panel 50 to simulate slate tiles or wood shakes. In all cases, however, the linear impressions would extend only within a single row. For such other linear impressions, the stamping station 104 would be designed accordingly, with appropriate slots and dies.

Accordingly, there has been disclosed an improved roll forming machine for producing an indeterminate length metal roof panel. While an illustrative embodiment has been disclosed herein, it is understood that various modifications and adaptations to the disclosed embodiment will be apparent to those of ordinary skill in the art and it is intended that this invention be limited only by the scope of the appended claims.

What is claimed is:

1. Apparatus for forming a metal roof panel of indeterminate length from a uniform width supply strip of sheet metal having a pair of parallel straight longitudinal edges, said apparatus providing a path for said sheet metal strip and comprising:

a stamping station effective to form linear impressions in the sheet metal strip, each of the linear impressions having its lateral extent limited such that on said sheet metal strip there is at least one longitudinal strip parallel to said longitudinal edges in which there are none of said linear impressions; and a series of spaced forming stations located in the path of said sheet metal strip following said stamping station, each of said forming stations having upper and lower driven shaping rollers between which said sheet metal strip is passed so as to impart a desired shape to the sheet metal strip which is uniform along the length of the sheet metal strip after it exits the apparatus, said series of spaced forming stations being effective to bend said sheet metal strip in opposite directions at substantially right angles along at least one pair of straight lines parallel to said longitudinal edges so as to form at least one Z-shaped bend parallel to said longitudinal edges, each of said at least one pair of straight lines lying within a respective one of said at least one longitudinal strip, the spacing between any adjacent Z-shaped bends and between each of said longitudinal edges and the Z-shaped bend adjacent said each longitudinal edge being substantially equal so as to divide said sheet metal strip into at least two longitudinal rows.

2. The apparatus according to claim 1 wherein said stamping station is effective to form each linear impression as a straight line transverse to the longitudinal edges of the sheet metal strip.

3. The apparatus according to claim 2 wherein said stamping station is effective to form each straight line impression orthogonally to said longitudinal edges.

4. The apparatus according to claim 3 wherein said stamping station is a rotary stamper comprising:

a first roller formed with two diametrically opposed straight axial slots on its surface, the axis of said first roller being orthogonal to said longitudinal edges;

a second roller having a plurality of straight axial dies protruding from its surface and equal in number to the number of longitudinal rows on said shaped sheet metal strip. each of said dies corresponding to a respective one of said longitudinal rows, each of said dies being complementary to respective one of said slots and adapted to force said sheet metal into the respective one of said slots when said sheet metal strip is fed between said first and second rollers to thereby form straight line impressions in said sheet metal strip, said dies being arranged on said second roller in diametrically opposed relation so that alternate dies along the length of said second roller cooperate with alternate ones of said first roller slots, the length of each of said dies being less than the width of its respective longitudinal row and the axial position of each of said dies being such that each linear impression is entirely within a respective longitudinal row; and means for rotating said first and second rollers in registration so that said dies enter the respective ones of said slots when said first and second rollers are rotated.

5. The apparatus according to claim 4 wherein:

there are exactly two Z-shaped bends so that said sheet metal strip is divided into three longitudinal rows; and there are exactly three straight axial dies on said second roller, with the center die along the length of said second roller cooperating with a first of the first roller slots and the other two dies cooperating with the other of the first roller slots.

6. The apparatus according to claim 4 wherein at each of said spaced forming stations the shaping roller on the same side of the sheet metal strip as the stamping station first roller is configured so as not to contact any straight line impressions.

7. The apparatus according to claim 1 further including a series of spaced edge bending stations between selected ones of said spaced forming stations for bending said longitudinal edges of said sheet metal strip into complementary shapes so that a pair of formed metal roof panels can have their edges interlocked when said pair of panels are arranged edge to edge.

* * * * *